US005821466A

United States Patent [19]

Clark et al.

[11] Patent Number: 5,821,466

[45] Date of Patent: Oct. 13, 1998

[54] MULTIPLE TWISTED PAIR DATA CABLE WITH GEOMETRICALLY CONCENTRIC CABLE GROUPS

[75] Inventors: William T. Clark, Leominster; Joseph Dellagala, Shrewsbury; Robert Allen, Leominster, all of Mass.

[73] Assignee: Cable Design Technologies, Inc., Leominster, Mass.

[21] Appl. No.: 772,593

[22] Filed: Dec. 23, 1996

[51] Int. Cl.[6] ..... H01B 11/02

[52] U.S. Cl. ..... 174/113 R; 174/121 A

[58] Field of Search ..... 174/27, 113 R, 174/121 A; 385/106

[56] References Cited

U.S. PATENT DOCUMENTS

| | | | |
|---|---|---|---|
| 3,644,659 | 2/1972 | Campbell | 174/27 |
| 5,149,915 | 9/1992 | Brunker et al. | 174/113 R X |
| 5,155,789 | 10/1992 | Le Noane et al. | 385/106 |
| 5,180,884 | 1/1993 | Aldissi | 174/36 |
| 5,202,946 | 4/1993 | Hardin et al. | 174/113 R X |
| 5,214,243 | 5/1993 | Johnson | 174/36 |
| 5,216,204 | 6/1993 | Dudek et al. | 174/102 SC |
| 5,418,878 | 5/1995 | Sass et al. | 385/101 |
| 5,424,491 | 6/1995 | Walling et al. | 174/113 R |
| 5,434,354 | 7/1995 | Baker et al. | 174/36 |
| 5,493,071 | 2/1996 | Newmoyer | 174/113 R |
| 5,544,270 | 8/1996 | Clark et al. | 385/101 |

*Primary Examiner*—Bot L. Ledynh
*Assistant Examiner*—Marc D. Machtinger
*Attorney, Agent, or Firm*—Wolf, Greenfield & Sacks, P.C.

[57] ABSTRACT

A high-speed data communications cable has geometrically concentric layers of twisted pairs of wires. A first, innermost layer includes a first twisted pair of wires having a unique lay length and a first and second dielectric filler. A second geometrically concentric layer is formed about the innermost layer and includes 9 twisted pairs of wires having 5 lay lengths. A third geometrically concentric layer is formed about the second layer and includes 25 twisted pairs of wires having 5 lay lengths. The first, second and third layers are enclosed in a thermoplastic jacket resulting in a flexible data cable with a minimal diameter. Additional layers of more twisted pairs of wires may also be used. A plurality of communication cables may also be commonly sheathed.

20 Claims, 1 Drawing Sheet

MULTIPLE TWISTED PAIR DATA CABLE WITH GEOMETRICALLY CONCENTRIC CABLE GROUPS

BACKGROUND OF THE INVENTION

1. Field of the Invention

The present invention relates to high-speed data communication cables using twisted pair wires. More particularly, it relates to cables having geometrically concentric groups of twisted pair wires.

2. Discussion of Related Art

Cables for high-speed data communications typically consist of multiple twisted pairs of wires. As the number of pairs increases, pair-to-pair crosstalk becomes a difficulty. As crosstalk increases, the data integrity diminishes and data can become lost. The industry has set certain standards for crosstalk, including powersum crosstalk, as defined in the latest standard, EIA/TIA-568-A.

Various cable configurations have been used in order to reduce crosstalk and meet the industry standards. In one design, the twisted pair wires are separated into small groups which are insulated and cabled together. In a second design, groups of wire pairs are formed around fillers, generally having a tubular construction. Each of the groups is laid side-by-side in an outer jacket forming an oval. Another design includes five groupings of wire pairs around fillers which are cabled together in a jacket having a star type configuration. Each of these configurations are difficult to use. The non-round configurations limit flexibility and hinder installation in conduits and around bends, and the additional fillers used with each group increases the size of the cable. In addition, the positioning of the various groups hinders separating pairs of wires for making connections.

High-speed data cables consisting of multiple twisted pairs of wires come in various sizes, featuring varying numbers of multiple twisted pairs. A commonly-used type of high speed data cable includes 25 twisted pairs formed within a circular jacket. In this particular size of cable, there are two industry standard design schemes, both of which include three concentric layers of twisted pairs. In one scheme, the cable includes 2 twisted pairs in the core of the cable, 8 twisted pairs in the second layer, and 15 twisted pairs in the third layer. In another scheme, the cable includes 3 twisted pairs in the core of the cable, 9 twisted pairs in the second layer, and 13 twisted pairs in the third layer. In each of these schemes, the core of the cable is well nested within the cable lay-up and, as a result, the core is inherently prone to cross-talk problems. Furthermore, because neither of these schemes are truly concentric, the physical placement of the individual pairs of wires is not relyably stable over time. That is, the pairs of wires tend to move in response to physical movement of the cable.

Therefore, a need exists for a cable having multiple twisted pairs of wires with minimal crosstalk and improved handling and termination capabilities.

SUMMARY OF THE INVENTION

The present invention overcomes the deficiencies of prior cable designs by providing an inner core that is resistant to cross-talk and is surrounded by geometrically concentric groups of twisted pairs of wires. In one aspect of the invention, the inner core includes a single twisted pair of wires. Second and third layers of twisted pairs of wires are concentrically placed about the inner core and a thermoplastic jacket is formed about the third layer. In another aspect of the present invention, a fourth layer of twisted pairs of wires is concentrically formed about the third layer between the third layer and the thermoplastic jacket. In another aspect of the invention, the numbers of twisted pairs in the second, third and fourth layers are selected to provide stable positioning even when the cable is moved. In another aspect of the present invention, a high speed data communication cable includes a plurality of cables surrounded by a common sheath.

DETAILED DESCRIPTION OF PREFERRED EMBODIMENTS

A patent application by the same applicant describes a communication cable having the first layer of twisted pairs around a central filler including 9 twisted pairs of wires and a secondary filler. The first layer of twisted pairs are locked into fixed positions that remain stable despite physical movement of the cable. The secondary filler is placed in the first layer to control wire position and maintain a round shape. The first layer, including the secondary filler, is cabled together with a nylon binder and enclosed in a thermoplastic jacket. A second group of 16 twisted pairs of wires and another secondary filler is formed concentrically around the thermoplastic jacket of the first layer, and is cabled together with a nylon binder and enclosed in a thermoplastic jacket. Again, the secondary filler controls wire placement and roundness of the cable. Although this cable is flexible, round, reduces crosstalk, and prevents movement of the twisted pairs when the cable is physically moved, the use of the central dielectric filler and the secondary fillers increases the diameter of the cable compared to common cable design schemes. Embodiments of the present invention, on the other hand, yield a flexible and round high-speed multiple twisted pair data cable with reduced crosstalk, particularly in the central core, which is smaller in diameter than the cable of the aforementioned patent application.

Figure 1:
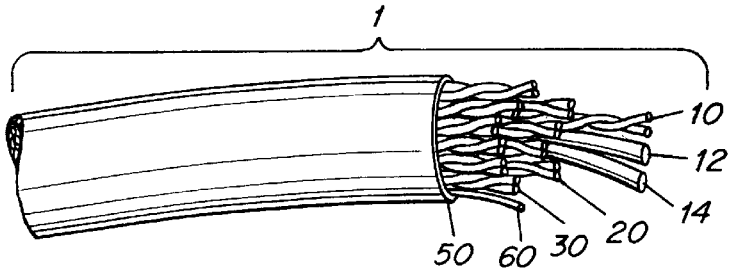
FIG. 1 is an illustration of a data communication cable according to a first embodiment of the present invention.
Figure 2:
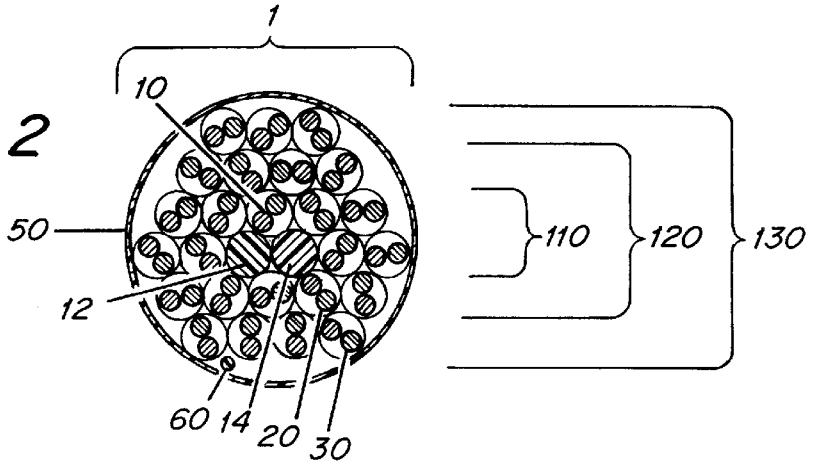
FIG. 2 is a cross sectional view of the data communication cable according to the first embodiment of the present invention.

As illustrated in FIGS. 1 and 2, a data communications cable 1 according to a first embodiment of the present invention includes a first layer 110 of a single twisted pair that forms a central core, a second layer 120 that includes a group of 9 twisted pairs of wires, and a third layer 130 that includes a group of 15 twisted pairs of wires. A thermoplastic jacket 50 encloses the entire cable assembly. Preferably, the thermoplastic jacket 50 has a thickness of approximately 0.02 inches and a diameter of approximately 0.470 inches when the data communication cable 1 includes 25 twisted pairs of wires. In FIG. 2, the circles that surround the individual twisted pairs of wires, for example, those circles surrounding pairs 10, 20, and 30, are for illustration purposes only and merely show the geometrically concentric placement of the twisted pairs. They are not meant to convey that each twisted pair is enclosed in a jacket.

The first layer 110 forming the central core includes a single twisted pair of wires 10 and first and second fillers 12,14. The first and second fillers 12,14 each have a diameter that is approximately equal to the diameter of the twisted pair of wires 10, thus forming a geometrically stable central core. Of course, the filler may have dimensions which are not equal to the diameter of the twisted pair of wires, as long as geometric stability is maintained. The twisted pair of wires 10 is, preferably, formed of two number 24 AWG (solid) bare copper wires with thermoplastic insulation and has a lay length of less than 0.400 inches. The lay length of the twisted pair of wires 10 is distinctly unique to the lay lengths of the remaining twisted pairs in the second and third layers 120, 130. The use of a distinctly unique lay length in the twisted pair of wires 10 combined with the first and second fillers 12, 14 in the central core reduces crosstalk in the central core. In addition, the similar diameters of the twisted pair 10, and the first and second fillers 12 and 14, permit the second and third layers 120, 130 to be formed concentrically around the central core in a geometrically stable placement. This, in turn, results in a flexible and round data cable 1 that has a reduced diameter and in which a minimal number of different twisted pair lay lengths are required. Preferably, the first and second fillers 12, 14 are formed of a dielectric or insulating material. Alternatively, the first and second fillers 12, 14 can be an optical fiber or a bundle of optical fibers. The optical fibers can then be used for additional data communication capacity.

The second layer 120 of the cable assembly includes 9 twisted pairs of wires 20 grouped in a single geometrically concentric layer around the central core. Only five different lay lengths, from approximately 0.450 inches to approximately 0.600 inches, are used for the 9 twisted pairs of wires of the second layer. Of course, a lesser number of different lay lengths could be used, provided that the crosstalk requirements for the cable's particular performance level can still be met. The twisted pairs of wires in the second layer 120 are, preferably, formed of the same type of wire as that used in the twisted pair of the central core, two number 24 AWG (solid) bare copper wires with thermoplastic insulation. However, one or more of the twisted pairs of wires in the second layer 120 could be substituted with a filler, a fiber optic fiber, or bundle of fiber optic fibers.

The third layer 130 of the cable assembly includes 15 twisted pairs of wires 30 grouped in a single geometrically concentric layer around the second layer. Only five different lay lengths, from approximately 0.390 inches to approximately 0.910 inches, are used for the 15 twisted pair wires. As in the second layer, a lesser number of different lay lengths could be used, provided that the crosstalk requirements for the cable's particular performance level can still be met. The twisted pairs of wires in the third layer 130 are also, preferably, formed of the same type of wire as that used in the inner core and the second layer. As in the second layer, one or more of the twisted pairs of wires in the third layer 130 could be substituted with a filler, a fiber optic fiber, or bundle of fiber optic fibers. By geometrically surrounding the second layer, the third layer prevents individual twisted pairs of wires in the second layer from wandering due to physical movement of the cable. That is, the third layer dispenses with the need to tie together the second layer with a binder. The elimination of a binder minimizes the cable diameter and improves flexibility of the data cable. In a preferred embodiment of a 25 pair cable, the first, second, and third layers are enclosed by a thermoplastic jacket 50. Immediately inside the thermoplastic jacket is a ripcord 60 that is longitudinally aligned in the cable and facilitates the removal of the thermoplastic jacket and adds tensile strength to the cable. Ripcord 60 is, preferably, made out of nylon.

Shielding of a known type can be used in addition to the thermoplastic jacket. Shielding can include helically wrapped foil in single or multiple layers, longitudinally wrapped foil, and metal wire braid. If shielding is used, the twisted pair wires may be wrapped with an insulating layer inside the shielding layer. Additional insulating layers can also be included between the shielding layer and the outer jacket. When a ripcord is included in a shielded cable, the ripcord is placed immediately inside the thermoplastic jacket, as described above.

Figure 3:
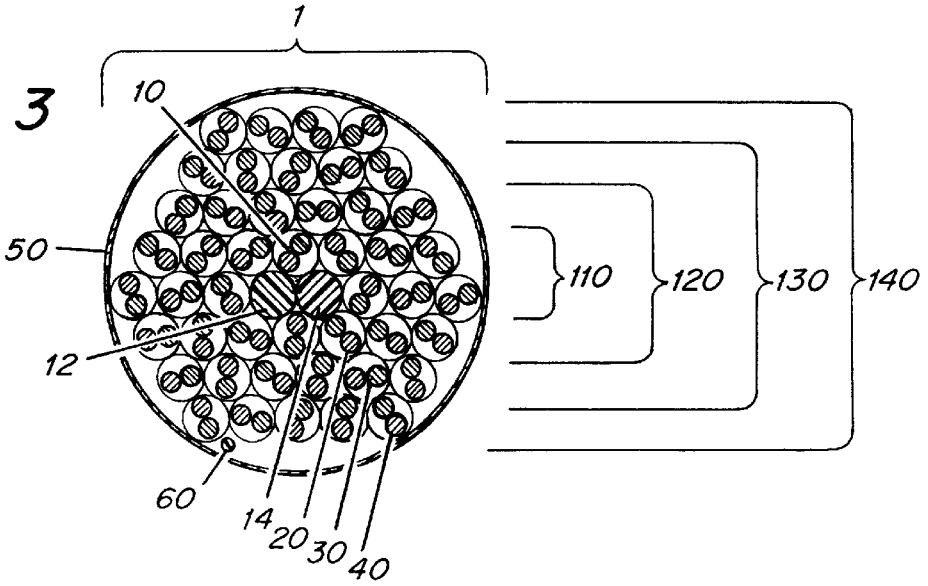
FIG. 3 is a cross sectional view of a data communication cable according to a second embodiment of the present invention.

A second embodiment of the present invention is illustrated in FIG. 3. The second embodiment includes a fourth layer 140 of twisted pairs of wires formed in a single geometrically concentric layer around the third layer 130. The fourth layer 140 includes 21 twisted pairs of wires 40 having 5 lay lengths greater than 0.400 inches and less than or equal to 1.00 inches, and preferably formed of the same type of wire as that used in the rest of the cable. Alternatively, one or more of the twisted pairs of wires in the fourth layer 140 could be substituted with a filler, a fiber optic fiber, or bundle of fiber optic fibers. Because the second and third layers adequately isolatate the fourth layer from the central core, the lay length of the twisted pair of wires 10 in the central core need not be distinctly unique to each of the lay lengths of the twisted pairs in the fourth layer. As in the first embodiment, a thermoplastic jacket 50 surrounds all layers of the cable, and a ripcord 60 can be placed longitudinally inside the jacket to facilitate removal of the jacket. As in the first embodiment, the cable may, of course, be shielded. As noted with respect to FIG. 2, the circles surrounding the individual twisted pairs of wires 10, 20, 30, and 40 are for illustration purposes only, and are not meant to convey that each twisted pair is enclosed in a jacket.

Figure 4:
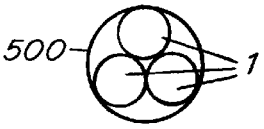
FIG. 4 is a cross sectional view of a data communication cable according to a third embodiment of the present invention.

A third embodiment of the present invention is illustrated in FIG. 4. The third embodiment includes a plurality of cables 1 according to the first or second embodiments that are enclosed within a common sheath 500. Preferably, each of the cables enclosed within the common sheath 500 would be shielded to prevent cross-talk with the other cables. Alternatively, the thermoplastic jackets on the cables may be sufficient to prevent crosstalk, and the shielding would not be needed.

Although preferred embodiments are specifically illustrated and described herein, it will be appreciated that modifications and variations of the present invention are covered by the above teachings and within the purview of the appended claims without departing from the spirit and intended scope of the invention. For instance, a cable according to the teachings of the present invention could include a plurality of additional layers, where each additional layer geometrically and concentrically surrounds the immediately adjacent prior layer.

What is claimed is:

1. A data cable comprising:

a first layer including one and only one single twisted pair of wires;

a second layer having a first plurality of twisted pairs of wires, said second layer concentrically surrounding and directly contacting said first layer, said first plurality of twisted pairs of wires being arranged in substantially continuous contact with said first layer and one another whereby mechanical stability of said first layer and said second layer is increased, each of said first plurality of twisted pairs of wires remaining within the second layer substantially throughout an entire length of said data cable;

a third layer having a second plurality of twisted pairs of wires, said third layer concentrically surrounding and directly contacting said second layer, said second plurality of twisted pairs of wires being arranged in substantially continuous contact with said second layer and one another whereby mechanical stability of said second layer and said third layer is increased, each of said second plurality of twisted pairs of wires remaining within the third layer substantially throughout said entire length of said data cable; and a jacket surrounding said third layer.

2. The data cable of claim 1, wherein said first layer further includes a first insulating filler and a second insulating filler.

3. The data cable of claim 2, wherein said first insulating filler is a fiber optic cable.

4. The data cable of claim 2, wherein said first plurality of twisted pairs of wires includes 9 twisted pairs of wires.

5. The data cable of claim 4, wherein said second plurality of twisted pairs of wires includes 15 twisted pairs of wires.

6. The data cable of claim 5, wherein said single twisted pair of wires has a lay length that is different than lay lengths of the first plurality of twisted pairs of wires and lay lengths of the second plurality of twisted pairs of wires.

7. The data cable of claim 6, wherein said lay lengths of said first plurality of twisted pairs of wires includes 5 different lay lengths between a range of 0.4 inch and 1.0 inch.

8. The data cable of claim 7, wherein said lay lengths of said second plurality of twisted pairs of wires includes 5 different lay lengths between a range of 0.4 inch and 1.0 inch.

9. The data cable of claim 2, wherein said first insulating filler and said second insulating filler have diameters that are approximately equal to a diameter of the single twisted pair of wires.

10. The data cable of claim 2, wherein said second plurality of twisted pairs of wires includes 15 twisted pairs of wires.

11. The data cable of claim 1, wherein said first and second plurality of twisted pairs of wires are arranged to minimize a cross-sectional area of said data cable.

12. The data cable of claim 11, wherein said jacket maintains a concentric positioning of said second plurality of twisted pairs of wires about said first plurality of twisted pairs of wires substantially throughout said entire length of said data cable.

13. The data cable of claim 1, further comprising a fourth layer concentrically surrounding said third layer between said third layer and said jacket, said fourth layer having a third plurality of twisted pairs of wires.

14. The data cable of claim 13, wherein said fourth layer further includes an insulating filler having a diameter that is approximately equal to a diameter of a twisted pair of wires of said third plurality of twisted pairs of wires.

15. The data cable of claim 14, wherein said insulating filler includes a fiber optic cable.

16. The data cable of claim 1, further comprising shielding between said third layer and said jacket.

17. A data cable comprising:

a plurality of data cables;

a common sheath about said plurality of data cables;

wherein at least one of said plurality of data cables includes:

a first layer having only a single twisted pair of wires, a second layer having a first plurality of twisted pairs of wires, said second layer concentrically surrounding and directly contacting said first layer, said first plurality of twisted pairs of wires being arranged in substantially continuous contact with said first layer and one another whereby mechanical stability of said first layer and said second layer is increased, each of said first plurality of twisted pairs of wires remaining within the second layer substantially throughout an entire length of said data cable, a third layer having a second plurality of twisted pairs of wires, said third layer concentrically surrounding and directly contacting said second layer, said second plurality of twisted pairs of wires being arranged in substantially continuous contact with said second layer and one another whereby mechanical stability of said second layer and said third layer is increased, each of said second plurality of twisted pairs of wires remaining within the third layer substantially throughout said entire length of said data cable, and a jacket surrounding said third layer.

18. The data cable of claim 17, wherein said at least one of said plurality of data cables is shielded.

19. The data cable of claim 17, wherein said first plurality of twisted pairs of wires includes 9 twisted pairs of wires.

20. The data cable of claim 17, wherein said second plurality of twisted pairs of wires includes 15 twisted pairs of wires.

* * * * *